United States Patent [19]

Petersen

[11] 4,264,818

[45] Apr. 28, 1981

[54] SINGLE-TANK X-RAY GENERATOR

[75] Inventor: Klaus Petersen, Henstedt-Ulzburg, Fed. Rep. of Germany

[73] Assignee: U.S. Philips Corporation, New York, N.Y.

[21] Appl. No.: 23,799

[22] Filed: Mar. 26, 1979

[30] Foreign Application Priority Data

Mar. 31, 1978 [DE] Fed. Rep. of Germany ..... 2813860

[51] Int. Cl.[3] ..... H05G 1/02

[52] U.S. Cl. ..... 250/420; 250/419

[58] Field of Search ..... 250/419, 402

[56] References Cited

U.S. PATENT DOCUMENTS 1,543,654 6/1925 Coolidge ..... 250/419

2,457,961 1/1949 Wehmer ..... 250/419

4,115,697 9/1978 Hounsfield et al. ..... 250/419

*Primary Examiner*—Davis L. Willis

*Assistant Examiner*—Thomas P. O'Hare

*Attorney, Agent, or Firm*—T. A. Briody; W. J. Streeter; R. E. Schneider

[57] ABSTRACT

There is provided a single-tank X-ray unit having a closed cooling circuit arranged in a housing for circulating a cooling agent to discharge the heat generated in the anode. The cooling circuit includes a feed duct and a return duct respectively wound helically around the high-voltage generator. A fan is so positioned in the housing as to pass cooling air over the cooling circuit, the housing having openings respectively for the intake of the cooling air and the discharge of the same.

3 Claims, 3 Drawing Figures

SINGLE-TANK X-RAY GENERATOR

Figure 1:
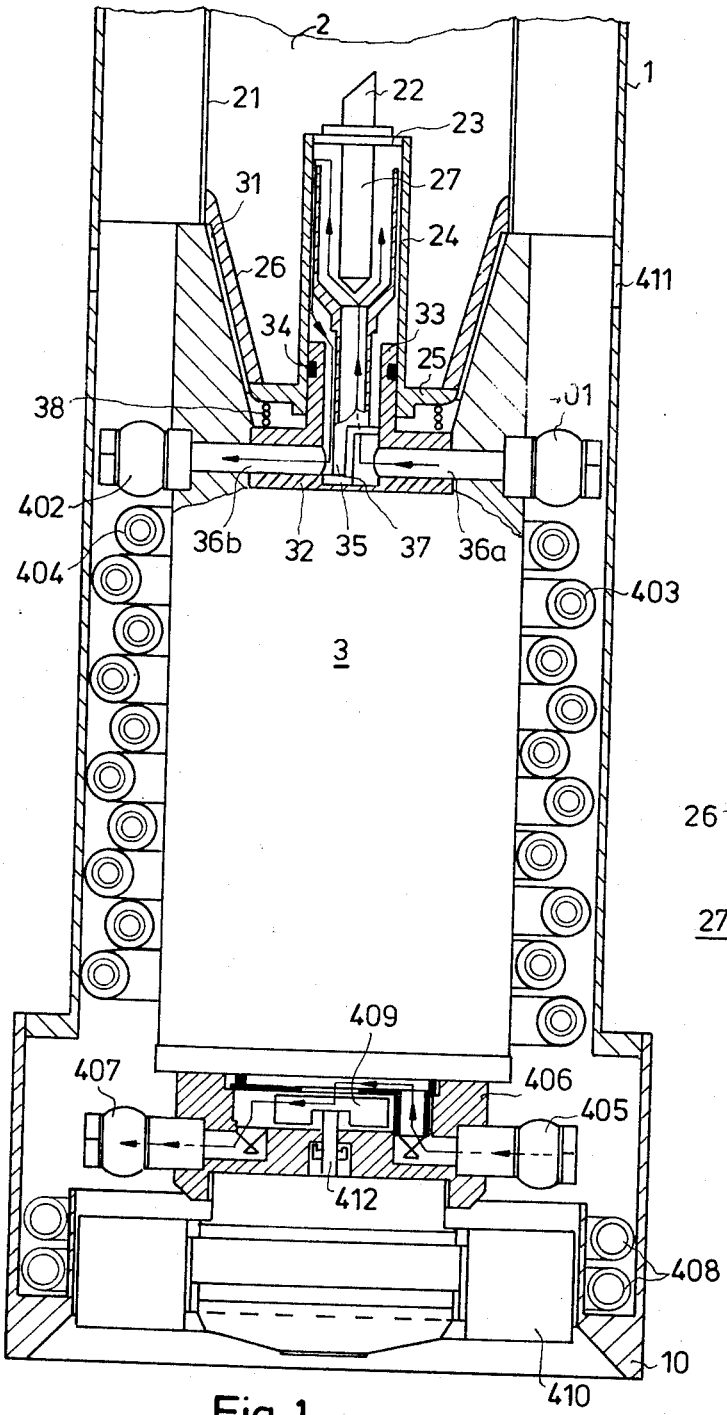

This invention relates to a single-tank X-ray generator having an X-ray tube and at least one high-voltage generator accommodated in one housing, the housing including a cooling device which dissipates the heat generated in the anode of the X-ray tube.

Such a single-tank X-ray generator is known ("Macrotank G 200" apparatus of Messrs. Philips). This apparatus uses, for cooling purposes, sulphur-hexafluoride which dissipates the heat generated in the anode of the X-ray tube to the housing. Also known are single-tank X-ray generators in which the oil utilized for insulating purposes also serves to transfer the heat generated in the anode to the housing.

These two known generators have in common that continuous operation is not possible when the heat is not dissipated from the housing by means of additional water cooling. However, such water cooling requires a water supply and water supply pipes which are not always available in the locations where such a generator is used (for example in shipyards). In addition, connecting water hoses to such an X-ray generator makes it less easy to handle. If, on the contrary, water cooling is dispensed with, the X-ray generator remains more mobile and can then also be used in locations where a connection to the water mains is not available but the on/off ratio at full load is then only approximately 30% (that is to say the ratio of the operation period to the period of rest is 3:10, the generator not being operative for more than 10 minutes). However, thus turn-on time is not sufficient to make an X-ray recording of thick steel plates or steel tubes.

Other X-ray apparatus intended for industrial use is already known which—also in continuous operation—has a considerably higher efficiency. Therein the high-voltage generator and the X-ray source are arranged in separate housings and interconnected by means of high-voltage cables. Cooling is effected by means of a separate cooling unit which is connected to the X-ray source via supply and discharge hoses. However, the cooling unit has a considerable weight—which also applies to the X-ray source and the high voltage generator—so that such an X-ray unit can actually be used only for stationary operation.

It is an object of the present invention to provide a single-tank X-ray generator which has a high efficiency also in continuous operation, a low weight and does not require external connections for the supply of a cooling agent and can therefore also be used as a mobile apparatus.

According to the invention this object is accomplished in that the cooling device comprises a closed cooling circuit, wherein a pump circulates a liquid cooling agent which dissipates the heat generated in the anode, in that a fan cools the cooling circuit and, consequently, the cooling agent, and in that the housing is provided with air inlet and outlet openings.

Water or transformer oil can be used as the cooling agent depending on whether the anode cooled by the cooling agent carries earth potential or a high voltage in the operating condition. No air or gas, is enclosed in the cooling circuit since they flow upwards and—when the single-tank X-ray generator is in a position in which the anode is at the highest point of the cooling circuit—they render an effective cooling of the anode impossible. On the other hand liquid cooling agents expand when heated and therefore the volume of the cooling circuit must change correspondingly. It is known that in X-ray apparatus the expansion of the insulating oil can be compensated for by a bellows-shaped expansion vessel. The use of such an expansion vessel in the cooling circuit of a single-tank X-ray generator according to the invention is, however, hardly possible. In a particularly simple embodiment of the invention the cooling agent circuit includes an expandable elastic tube. The cooling agent flows through this tube and causes it to expand when the cooling agent temperature increases and to contract when the cooling agent cools down again. In the most simple case the tube consists of rubber, which must be oil-resistant when oil is used as the cooling agent.

In a further embodiment of the invention an elongate cooling member consisting of metal and extending approximately along the longitudinal tube axis and projecting into a cavity outside the X-ray tube, a cooling agent flowing through this cavity, is connected to the anode. With known X-ray generators a so-called spray nozzle, that is to say a flat disc, provided with many holes through which the cooling oil is forced onto a flat disc which is in thermal contact with the anode is used to cool the anode. Another possibility is to increase the cooling area of the anode by providing the rear side with a pattern of grooves. Both embodiments have in common that the cooling oil must be forced with a relatively high speed through the channels made by the groove pattern or through the apertures in the spray nozzle. To that end the cooling oil must be forced with a considerable pressure (more than 0.5 MPa) through the circuit. The embodiment according to the invention requires only a pump pressure of approximately 20 kPa.

In an embodiment of the invention, which is especially suitable for the above-mentioned arrangement according to the invention, the fan shaft is provided with a pump wheel which is arranged in a housing having a cooling agent supply and discharge pipe and pumps the cooling agent through the cooling circuit.

In the prior art single-tank X-ray generators the anode had to be in thermal contact with a bulky cooling member so that the heat generated in the anode could be dissipated via the cooling member and the cooling agent to the housing. It was therefore not possible to provide the high-voltage generator and the X-ray tube each with a high-voltage insulator and to construct them so that together they constitute a high-voltage connector pair—as described published West German application OS No. 2,537,019—as in that construction, which allows a particularly simple assembly, the anode or a cooling member coupled therewith is located within the high-voltage connector. However, the invention can also be used for such a design of the X-ray tube and the high voltage generator. Accordingly, an embodiment of the invention has the features that the X-ray tube and the high-voltage generator comprise insulators, the insulator of the X-ray tube being connected to the anode and the insulators being shaped so that they constitute together a high-voltage connector pair, that the X-ray tube is constructed so that in the high-voltage generator X-ray tube assembly a cavity is formed which is thermally coupled to the anode, that the flow of cooling agent is passed into the cavity by means of an inlet and an outlet and that a separator is provided inside the cavity for separating the inflowing and outflowing cooling agent.

In its most simple form the separator can be of such a form (for example flat) that it divides the cavity in the longitudinal direction into two halves, one half comprising the inlet opening and the other half the outlet opening, the two halves being interconnected via an interruption in the separator near the anode cooling member. However, a more efficient design of the separator consists in accordance with an embodiment of the invention in that the separator is of a tubular shape and has an opening which either faces the inlet opening or the outlet opening and that a flange is provided on the tube which closes the cavity around the tube so that a direct flow of the cooling agent from the inlet opening to the outlet opening around the tube cannot occur.

A particularly advantageous cooling possibility is obtained when the cooling member projects into the tubular separator. The latter must then be dimensioned so that the cross-sectional area available in its interior for the passage of the cooling agent corresponds to the cross-sectional area between the tube outer wall and the boundary of the cavity.

For a single-tank X-ray generator in which the X-ray tube and the high-voltage generator are provided with insulators which are of such a shape that they constitute together a high-voltage connector pair, a particularly compact construction is obtained when in accordance with an embodiment of the invention tubes are provided for the feed-forward and for the feed-back of the cooling agent, respectively, which are wound helically around the "cylindrical" high voltage generator. These tubes are therefore accommodated in the cylindrical space remaining between the inner wall of the housing and the outside of the high-voltage generator and are cooled by the air current produced by the fan.

Figure 2A:
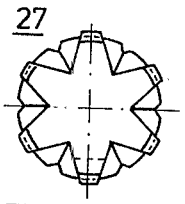
Figure 2B:
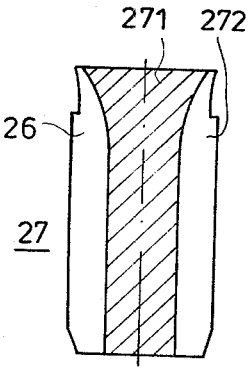

The invention will now be further explained with reference to the accompanying drawing, in which:

FIG. 1 is a cross-sectional of a portion of a single-tank X-ray generator, and FIGS. 2*a* and 2*b* are an elevation view and a side view respectively of a cooling member which is in proper thermal contact with the anode.

FIG. 1 shows a portion, which is essential for the invention, of a single-tank X-ray generator, an X-ray tube 2 and a high-voltage generator 3 being arranged in a housing 1. Recognizable in the X-ray tube is a part of the metal bulb 21 as well as the anode 22 whose bottom plate 23 is connected to a tube 24 which is connected via a plate 25 to a ceramic insulator 26 which is of a conical shape and connects the plate 25 to the metal bulb 21 in a vacuum-tight manner.

The construction of the high-voltage generator 3 is not shown in detail. The components producing the high voltage are cast in a suitable moulding resin whose outer surface is of a circle-cylindrical shape. The insulator block thus formed is provided at the end facing the X-ray tube 2 with an inwardly tapering recess which is adapted to the form of the ceramic insulator 26. This shape results in a high-voltage connector pair between the X-ray tube and the high-voltage plug which are joined together when the single-tank X-ray generator is assembled, a rubber collar 31 being interposed, so that the insulating part of the high-voltage generator envelops the ceramic insulator of the X-ray tube.

an electrode body 32 consisting of metal and carrying the high voltage in the operating condition is provided on the front face of the high-voltage generator. It is a circular shape and has a hole in its centre parallel to the disc surface and perpendicular to the longitudinal axis of the X-ray tube 2 and the housing 1, respectively. In addition, it is provided with a tube coupling member 33 which ends in the hole and which is accommodated in the operating condition in the cylindrical tube 24 of the X-ray tube 2, a rubber ring 34 ensuring that there is an oil-tight connection between the outer surface of the tube coupling member 33 and the inner surface of the tube 24. A spring 38 produces a safe electrical contact between the front face of the electrode body 32 and the plate 25 of the X-ray tube, so that in the operating condition the anode is connected to the high voltage via the bottom plate 23, the tube 24, the plate 25, the spring 38 and the electrode body 32. When the tube coupling member 33 is in very intimate contact with the electrode body 32 a direct electric connection between the electrode body 32 and the tube 24 is also obtained.

The hole in the electrode body is divided into two halves by a separator 35 so that an oil inlet opening 36*a* and an oil outlet opening 36*b* are formed in the electrode body. The tubular separator is concentrically arranged with respect to the tube 24 of the X-ray tube in its interior and extends from the bottom of the electrode body to close to the plate 23. In the region of the inlet opening 36*a* the separator has an incision so that its cross-section in this region corresponds to a semi-circular ring. In this region the tube is further provided with a flange 37 which closes the space around the tubular separator against the inlet opening 36*a*. The oil flowing in through the inlet opening 36*a* can therefore not flow directly to the outlet opening 36*b* but flows first through the interior of the separator 35.

The tubular separator widens towards the anode 22 and envelops a cooling member 27 which is so connected to the anode plate 23 that a proper thermal contact between the cooling member 27 and the anode is produced.

In FIGS. 2*a* and 2*b*, it can be seen that the cooling member has a somewhat star-shaped cross-section and consists of a solid centre section 271 whose diameter increases towards the anode, and is provided with star-shaped cooling grooves 272 which are uniformly distributed along the circumference. The tubular separator mates directly by means of its widened portion with the outer edges of the star-shaped cooling grooves 272. As indicated by means of lines provided with arrows the oil flows through the inlet opening 36*a* into the interior of the tubular separator, flows around the cooling member 27, leaves the separator in the vicinity of the anode plate 23 and then passes through the intermediate space between the separator 35 and the tube 24 and the tube coupling member 33, respectively, to flow thereafter to the outlet opening 36*b*. The separator is dimensioned so that the cross-sectional area in its interior for the passage of the oil corresponds to the area between the outer wall of the separator and the tube 24 and the tube coupling member 33, respectively, so that no narrowing of the cross-section occurs. This prevents an unnecessary decrease of the pressure the hole through the electrode body 32 continues into the moulding resin body of the high-voltage generator 3, each end terminating in an annular support 401 and 402, respectively. Tubes 403 and 404, respectively, are connected in a manner not shown to the two annular supports. The cooling oil flows through these metal tubes which are so-called finned tubes, that is to say their circumference is provided with closely adjacent disc-shaped metal sheets located in a vertical plane to the tube axis and which considerable increase the cooling surface of the tubes. Both tubes are wound with the same winding sense helically around the high-voltage generator, the winding diameter of, for example, tube 403 exceeding that of the tube 404, so that the winding consisting of the tubes 403 and 404 fills a considerable portion of the space between the high-voltage generator 3 and the housing 1. The tube 404 is connected in a manner not further shown to an annular support 405 which is secured to an oil pump housing 406 which in its turn is connected to the front face which faces away from the X-ray tube, of the high-voltage generator 3. A pump wheel 409 arranged in the pump housing 406 pumps—as shown in the drawing by means of arrows—the oil which enters through the annular support 405 to a further annular support 407, which is provided at the pump housing 406 in the same plane but shifted 180° with respect to the pump support 405. From there a connection, not further shown, leads to an expansion tube 408 which has an inside diameter of 9 mm, a wall thickness of 2 mm and a length of approximately 900 mm. The elastic expansion tube 408 absorbs the changes in volume occurring when the oil, which has a volume of approximately 400 $cm^3$ is heated so that the tube performs the function of an expansion vessel as used, for example, in apparatus for X-ray diagnoisis.

The other end of the tube 408 is connected in a manner not further shown to the tube 403 so that the following oil circuit is obtained: annular support 407—expansion tube 408—finned tube 403—annular support 401—inlet opening 36*a*—separator 35 (internal) along the cooling member 27—outlet opening 36*b*—annular support 402—finned tube 404—annular support 405.

The circulating oil cooling circuit formed in this manner is cooled by means of a fan 410 which is secured to the pump housing 406. for the supply and discharge of air the cover 10 of the housing below the fan as well as the wall of the housing beyond the tubes 403, 404 is provided with holes 411. The air circuit produced by the fan 410 cools the finned tubes 403 and 404 and is thereafter discharged—heated—through the openings provided in the housing.

Since, as mentioned above, the pump must be designed for a very small difference in pressure only it is possible to fasten the pump wheel 409 to the shaft 412 of the fan, so that the pump wheel 409 is driven by the fan 410 so that a separate oil pump is not required.

The construction shown in the drawing renders it possible to load the anode 22 in continuous operation with 1.3 kW. For the prior art single-tank X-ray generators such a load was only possible by means of additional externally connected cooling or only for a short period of time with a switch on/off ratio of 30%. The weight of the cooling device is relatively small, as only a small quantity of oil (approximately 0.5 l) is used for the cooling and the components of the cooling circuit (tubes 403, 404, pump housing 406 etc.) can be relatively light. Such a single-tank X-ray generator can therefore also be used as a portable apparatus in test positions where no connections to a water supply or other external cooling features are available and where thick-walled steel objects must be examined which require long (uninterrupted) recording periods.

What is claimed is:

1. A single-tank X-ray unit for continuous operation, which comprises a unitary housing; an X-ray tube including an anode and an associated high-voltage generator both arranged in said housing; a closed cooling circuit also arranged in said housing for circulating a cooling agent to discharge the heat generated in the anode; a fan positioned in said housing for passing cooling air over the cooling circuit to cool the same, the cooling circuit including a feed duct and a return duct for the cooling agent respectively wound helically around the high-voltage generator and cooled by the cooling air; and openings provided in said housing respectively for the intake thereinto and the discharge therefrom of said cooling air.

2. A single-tank X-ray unit according to claim 1, in which the cooling circuit includes a cylindrical chamber connected respectively to the feed duct and the return duct and thermally coupled to the anode; and elongate cooling member connected to the anode and extending longitudinally into said cylindrical chamber; and a separator in the cylindrical chamber for directing the cooling agent from the feed duct into contact with said cooling member and then out into the return duct.

3. A single-tank X-ray unit according to claim 2, in which the separator has a tubular shape, and the cooling member projects into said tubular separator.

* * * * *